US006168255B1

(12) United States Patent
Nagashima

(10) Patent No.: US 6,168,255 B1
(45) Date of Patent: Jan. 2, 2001

(54) INK JET HEAD METHOD OF PRODUCTION THEREOF, AND JIG FOR PRODUCING INK JET HEAD

(75) Inventor: Mitsuyoshi Nagashima, Sayama (JP)

(73) Assignee: Citizen Watch Co., Ltd., Tokyo (JP)

( * ) Notice: Under 35 U.S.C. 154(b), the term of this patent shall be extended for 0 days.

(21) Appl. No.: 08/981,068

(22) PCT Filed: Jun. 12, 1996

(86) PCT No.: PCT/JP96/01588

§ 371 Date: Dec. 10, 1997

§ 102(e) Date: Dec. 10, 1997

(87) PCT Pub. No.: WO96/41721

PCT Pub. Date: Dec. 27, 1996

(30) Foreign Application Priority Data

Jun. 7, 1995 (JP) ..... 7-170537
Dec. 6, 1995 (JP) ..... 7-143778

(51) Int. Cl.[7] ..... B41J 2/015
(52) U.S. Cl. ..... 347/20; 156/290; 347/29
(58) Field of Search ..... 347/20, 29, 47, 347/31, 93, 71, 68, 92, 87; 156/290, 292

(56) References Cited

U.S. PATENT DOCUMENTS 4,500,894 * 2/1985 Kirner ..... 347/29
4,638,336 * 1/1987 Hofmann ..... 347/29
5,872,583 * 2/1999 Yamamoto et al. ..... 347/71 X

FOREIGN PATENT DOCUMENTS 3-173651 7/1991 (JP) .
3180350 * 8/1991 (JP) ..... 347/71
3277551 * 12/1991 (JP) ..... 347/71
4-5023 1/1992 (JP) .
4-31053 2/1992 (JP) .
5-69548 3/1993 (JP) .
5-220966 8/1993 (JP) .
6-15689 1/1994 (JP) .
6-31925 8/1994 (JP) .
6-336012 12/1994 (JP) .

* cited by examiner

*Primary Examiner*—John Barlow
*Assistant Examiner*—C Dickens
(74) *Attorney, Agent, or Firm*—Armstrong, Westerman, Hattori, McLeland & Naughton

(57) ABSTRACT

The present invention relates to an ink jet head for changing the volume in a pressure chamber by deformation of a laminate piezoelectric device and for jetting ink filled in the pressure chamber from the front openings of the pressure chamber through nozzle holes, and particularly to an ink jet head which is characterized by an adhesive layer interposed between the front end surface of the main body forming the pressure chamber and a nozzle plate. The nozzle plate is bonded to the front end surface of the main body via an adhesive layer formed by an adhesive. The adhesive layer is divided into a nozzle seal layer encompassing the nozzle holes and the periphery of the front openings of the pressure chamber, an outer periphery hermetic layer formed annularly around the outer periphery of a region in which the main body and the nozzle plate oppose each other, and a reinforcing layer distributed in an intermediate portion between the nozzle seal layer and the outer periphery hermetic layer.

2 Claims, 9 Drawing Sheets

INK JET HEAD METHOD OF PRODUCTION THEREOF, AND JIG FOR PRODUCING INK JET HEAD

This application is a PCT/JP96/01588 filed Jun. 12, 1996.

TECHNICAL FIELD

The present invention relates to an ink jet head for changing the volume in a pressure chamber by deformation of a laminate piezoelectric device and for jetting ink filled in the pressure chamber from the front openings of the pressure chamber through nozzle holes, particularly to an ink jet head which is characterized by an adhesive layer interposed between the front end surface of the main body forming the pressure chamber and a nozzle plate, a method of manufacturing the same, and a jig for manufacturing the ink jet head.

BACKGROUND TECHNOLOGY

A conventional ink jet head of this type is, for example, disclosed in the laid-open publication of JP-A 3-173651.

FIG. 8 shows the entire structure of the ink jet head as disclosed in the same publication, wherein a nozzle forming member 102 is bonded to a piezoelectric converter 101 fixedly secured onto a base member 100 by an adhesive 103.

The base member 100, the piezoelectric converter 101 and the nozzle forming member 102 are respectively incorporated in a frame 104, wherein an ink chamber 105 is formed in an intermediate portion between the piezoelectric converter 101 and the nozzle forming member 102. Ink 106 filled in the ink chamber 105 is discharged from nozzle holes 107 by deformation of the piezoelectric converter 101.

FIG. 9 is an enlarged sectional view showing in detail a construction of a bonding part between the piezoelectric converter 101 and the nozzle forming member 102 and the periphery thereof shown in FIG. 8. The piezoelectric converter 101 and the nozzle forming member 102 are bonded to each other by the adhesive 103 including space restriction particles 110 and conductive particles 111. Each of the space restriction particles 110 has a uniform grain size. A given gap, namely, the ink chamber 105, is formed between the piezoelectric converter 101 and the nozzle forming member 102 by the space restriction particles 110.

Meanwhile, the ink jet head as disclosed in the publication of JP-A 3-173651 has a structure that the end part of the nozzle forming member 102 is bonded to the piezoelectric converter 101, and the ink chamber 105 having a given interval is formed between the piezoelectric converter 101 and the nozzle forming member 102 as is evident from FIG. 9.

If the bonding spot of the nozzle forming member 102 is limited to the end part alone as set forth above, it is not necessary to consider any harmful effect like the nozzle holes 107 being blocked owing to the expansion of the adhesive 103. Accordingly, there is no description in publication JP-A 3-173651 regarding the amount of coating of the adhesive 103.

However, the amount of coating of the adhesive becomes a problem, for example, in the case where an entire back surface of a nozzle plate 201 is bonded to an end surface 200*a* of a piezoelectric module 200 in the ink jet head shown in FIG. 10.

That is, if the adhesive is coated onto the entire surfaces between the bonding surfaces of the end surface 200*a* of the piezoelectric module 200 and the nozzle plate 201, excess adhesive inevitably expands to the periphery thereof. Particularly, when the adhesive enters gaps 202 forming the ink chamber, there is a likelihood that the discharge characteristic of the ink will be deteriorated or nozzle holes 203 will be blocked.

The laid-open publication of JP-A 5-220966 discloses a method of preventing the ink chamber and the nozzle holes from being blocked by the expansion of the excess adhesive set forth below.

That is, a method of manufacturing the ink jet head disclosed in the same publication comprises supplying an adhesive 302 to a recessed plate 300 having a recessed part 301 as shown in FIG. 11A, then scraping off the excess adhesive 302 which bulges onto the recessed plate 300 by a blade 303 as shown in FIG. 11B, thereby leaving the adhesive 302 in the recessed part 301 alone.

Successively, the end surface (bonding surface of the nozzle plate) 200*a* of the piezoelectric module 200 is pressed against the recessed part 301, and then the piezoelectric module 200 is extracted thereafter so that a small amount of adhesive 302 is uniformly coated onto the end surface 200*a* of the piezoelectric module 200, as shown in FIG. 11C.

In such a manner, the method prevents the expansion of the excess adhesive 302 by bonding the nozzle plate 201 to the end surface 200*a* of the piezoelectric module 200 onto which the adhesive 302 is coated.

However, even in the method of manufacturing the ink jet head disclosed in the above-mentioned publication, there is a high possibility that the adhesive 302 filled in the bonding surfaces contains bubbles at random since the adhesive 302 is coated onto the entire bonding surfaces of the piezoelectric module 200 and the nozzle plate 201.

If the adhesive 302 hardens while it contains bubbles, hermeticity between the piezoelectric module 200 and the nozzle plate 201 is not maintained depending on the condition or position of the bubbles, thereby leading to a danger that ink leakage will occur and an electrode of the piezoelectric module 200 will be short-circuited.

The present invention has been made in view of these circumstances, and it is an object of the invention to bond between the front end surface of the main body and the nozzle plate strongly with high hermeticity, and to prevent the nozzle holes from being blocked by the expansion of the adhesive.

DISCLOSURE OF THE INVENTION

To achieve the above object, the ink jet head of the present invention is characterized in being structured as follows.

That is, the ink jet head comprises a main body for changing the volume in a pressure chamber by deformation of a laminate piezoelectric device, and feeding ink filled in the pressure chamber toward front openings of the pressure chamber, a nozzle plate having nozzle holes communicating with the front openings of the pressure chamber, and an adhesive layer formed between the front end surface of the main body and the nozzle plate by an adhesive.

The adhesive layer formed between the main body of the ink jet head and the nozzle plate comprises a nozzle seal layer of an arbitrary width in such a manner as to encompass the nozzle holes and the periphery of the front openings of the pressure chamber, an outer periphery hermetic layer of an arbitrary width being formed annularly around the outer periphery of a region in which the main body and the nozzle plate oppose each other, and a reinforcing layer being distributed in an intermediate portion between the nozzle seal layer and the outer periphery hermetic layer.

Since the nozzle holes and the front openings of the pressure chamber are sealed by the nozzle seal layer in the present invention having the construction set forth above, it is possible to prevent ink from leaking from the nozzle holes and the front openings.

Further, a sealing property can be further enhanced by the outer periphery hermetic layer, and particularly entrance of moisture, dust, etc., from the outside can be prevented. Still further, a large bonding strength can be secured by the reinforcing layer.

Further, a plurality of spherical bodies each having an extremely small diameter may be contained in the adhesive layer according to the ink jet head of the present invention. With such a construction, the thickness of the adhesive layer can be maintained constant by the existence of the spherical bodies, and the nozzle seal layer, the outer periphery hermetic layer and the reinforcing layer can be prevented from being collapsed so as to effectively perform their functions.

Meanwhile, a method of manufacturing an ink jet head of the present invention, comprising a main body for changing the volume in a pressure chamber by deformation of a laminate piezoelectric device, and feeding ink filled in the pressure chamber toward the front openings of the pressure chamber, and a nozzle plate bonded onto the front end surface of the main body in a state where nozzle holes communicate with the front openings of the pressure chamber, is characterized in comprising the following steps.

Adhesive coating step

In this step, the adhesive is coated onto the nozzle plate in such a manner as to encompass the front openings at the front end surface of the main body with an arbitrary width. Further, the adhesive is coated annularly along an outer periphery edge with an arbitrary width in a region where the nozzle plate is bonded to the front end surface of the main body. Still further, the adhesive is coated onto an intermediate region which is encompassed by each portion onto which the adhesive is coated in a distributed manner.

Since the adhesive is coated in such a manner, the nozzle seal layer, the outer periphery hermetic layer, and the reinforcing layer in the ink jet head of the present invention can be formed as mentioned in the foregoing.

Overlaying step

In this step, the nozzle plate is overlaid on the front end surface of the main body in a state where the nozzle holes conform to the front openings of the pressure chamber.

Pressing step

In this step, the nozzle plate which is overlaid on the front end surface of the main body in the overlaying step is pressed elastically. Since the nozzle plate is pressed elastically, the pressure applied to the adhesive is appropriately lessened to prevent the adhesive from being collapsed.

If a plurality of spherical bodies each having an extremely small diameter are contained in the adhesive used in the adhesive coating step, the thickness of the adhesive layer can be maintained constant by the existence of the spherical bodies so as to prevent the adhesive from being collapsed.

Each step of the method of manufacturing the ink jet head of the present invention may be carried out in the following method.

Adhesive coating step

The adhesive is coated onto the nozzle plate in such a manner as to encompass the nozzle holes with an arbitrary width. Further, the adhesive is coated annularly along an outer periphery edge with an arbitrary width in a region where the nozzle plate is bonded to the front end surface of the main body. Still further, the adhesive is coated onto an intermediate region which is encompassed by each portion onto which the adhesive is coated in a distributed manner.

Overlaying step

The front end surface of the main body is overlaid on the nozzle plate in a state where the front openings of the pressure chamber conform to the nozzle holes.

Pressing step

The nozzle plate overlaid on the front end surface of the main body is elastically pressed.

Also in this case, if plural spherical bodies each having an extremely small diameter are contained in the adhesive used in the adhesive coating step, the thickness of the adhesive layer can be maintained constant by the existence of the spherical bodies so as to prevent the adhesive from being collapsed.

Still further, the present invention provides a jig adapted for carrying out the method of manufacturing the ink jet head set forth above.

That is, the jig for manufacturing an ink jet head of the present invention comprises a main body of the jig for supporting the main body of the ink jet head, a pressing plate for supporting the nozzle plate while opposing the main body of the ink jet head supported by the main body of the jig, the pressing plate being freely movable in a direction of the main body of the jig, an elastic member provided on the pressing plate for elastically supporting the nozzle plate, and a suction means provided on the pressing plate for suctioning the nozzle plate against the elastic member.

Since the nozzle plate is pressed elastically by the elastic member in the jig for manufacturing the ink jet head, the pressing step in the method of manufacturing the ink jet head set forth above can be easily performed, and also the pressure applied to the adhesive is appropriately lessened to prevent the adhesive from being collapsed.

BEST MODE FOR CARRYING OUT THE INVENTION

Figure 1:
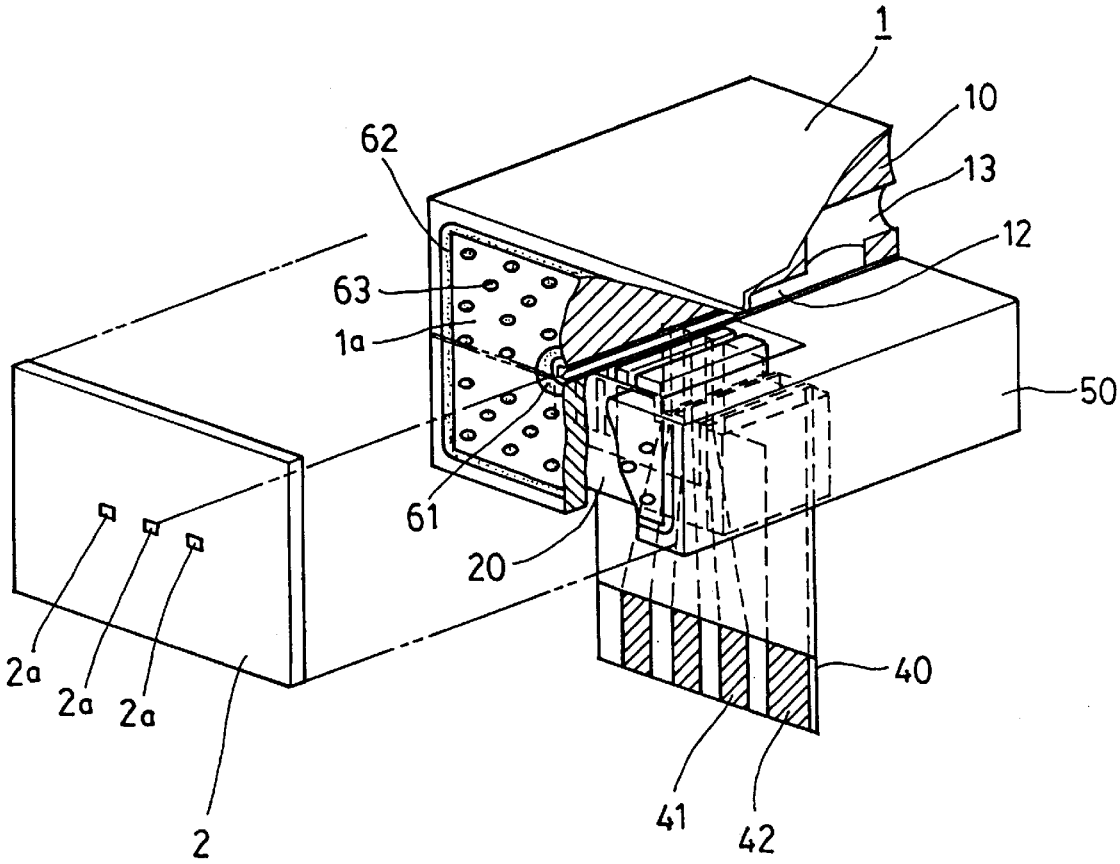
FIG. 1 is a perspective view of an ink jet head according to a mode for carrying out the invention in which the ink jet head is partially cut off.

The best mode for carrying out the present invention will be now described in detail with reference to the attached drawings.

The overall construction of an ink jet head will be first described with reference to FIGS. 1 to 4.

The ink jet head shown in these figures is provided with a main body 1 and a nozzle plate 2 having a plurality of nozzle holes 2*a*. The main body 1 comprises a pressure chamber 11, a flow path forming member 10 forming an ink flow path to the pressure chamber 11, a laminate piezoelectric device unit 20 which is deformed in the direction of the thickness thereof when a voltage is applied, a diaphragm 30 provided between the laminate piezoelectric device unit 20 and the flow path forming member 10, a flexible printed-circuit board 40 for applying a voltage to the laminate piezoelectric device unit 20, and the like.

The flow path forming member 10 has a common liquid chamber 12 at the rear end portion thereof. Ink is supplied to the common liquid chamber 12 through an ink supply port 13. A plurality of pressure chambers 11 are formed in a line on the bottom surface of the flow path forming member 10 extending from the intermediate portion to the front end portion thereof. Each pressure chamber 11 communicates with the common liquid chamber 12 through each orifice 14.

Figure 2:
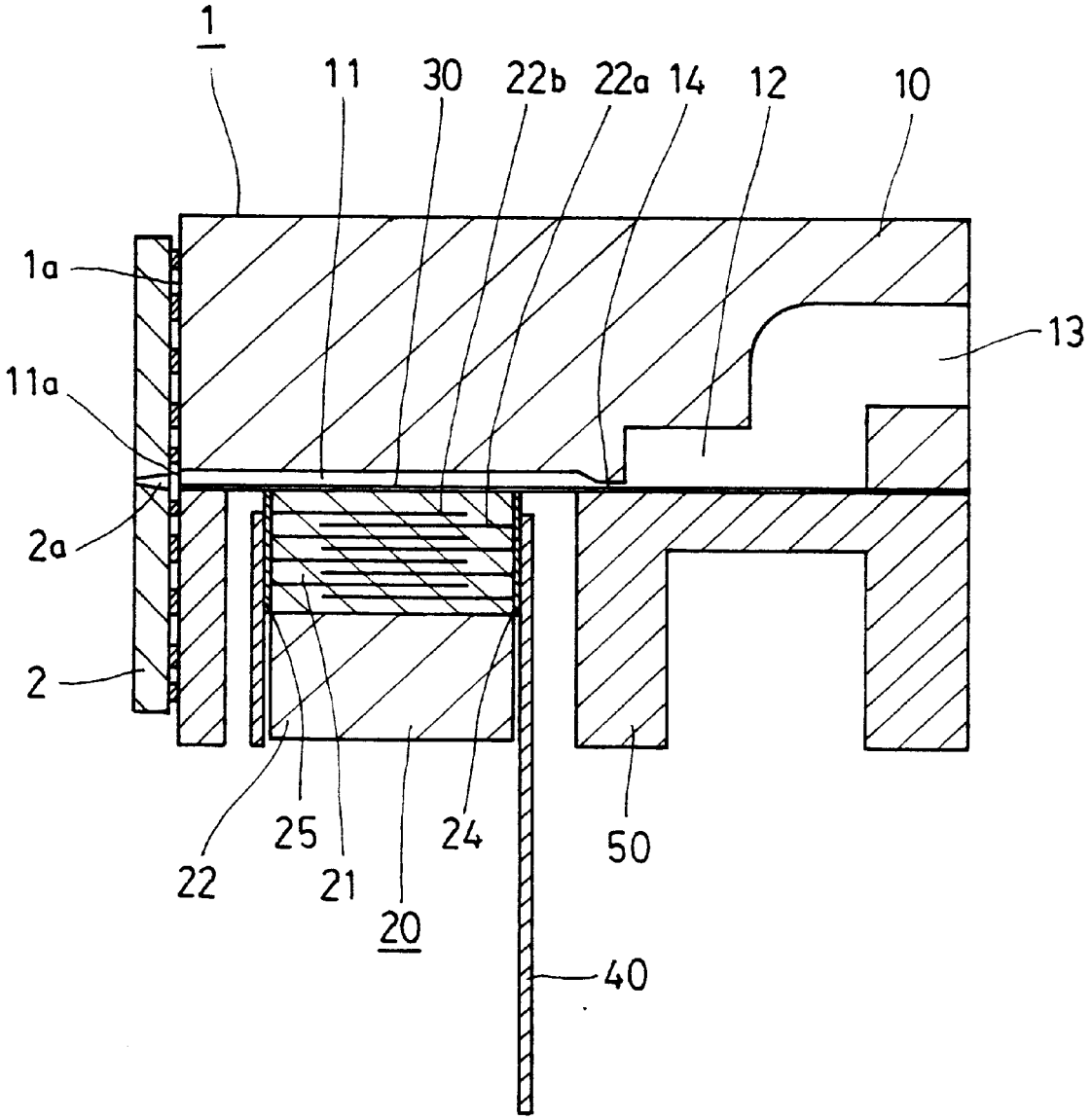
FIG. 2 is a side sectional view of the ink jet head shown in FIG. 1.
Figure 3:
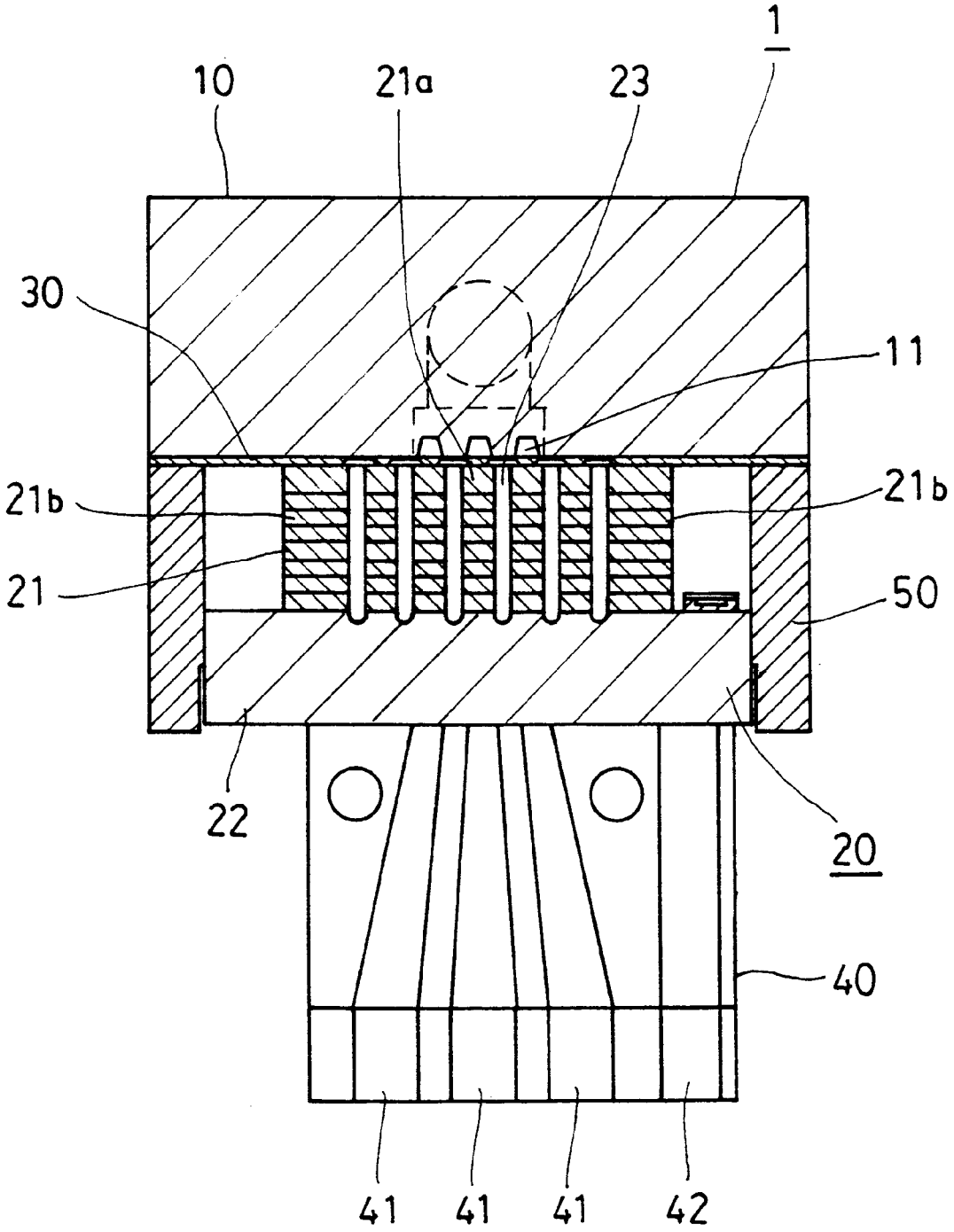
FIG. 3 is a front sectional view of the ink jet head shown in FIG. 1.

The laminate piezoelectric device unit 20 is bonded to the bottom surface of the flow path forming member 10 via the diaphragm 30. The laminate piezoelectric device unit 20 includes laminate piezoelectric bodies 21 and a base 22. The laminate piezoelectric bodies 21 are structured in such a manner that a plurality of plate-shaped piezoelectric members are laminated while they clamp electrode plates 22*a* and 22*b* therebetween as shown in FIG. 2.

Exposed ends of the electrode plates 22*a* and 22*b* are arranged alternately to the outside. For example, the electrode plates 22*a* corresponding to odd numbers counted from the bottom are exposed from the laminate piezoelectric bodies 21 at the rear end thereof, and the electrode plates 22*b* corresponding to even numbers counted from the bottom are exposed from the laminate piezoelectric bodies 21 at the front end portion thereof.

The laminate piezoelectric bodies 21 are bonded onto the upper surface of the base 22, and they are divided into a plurality of piezoelectric devices 21*a* by grooves 23. Each of the piezoelectric devices 21*a* (excluding piezoelectric devices 21*b* provided at both ends) is provided so as to oppose the pressure chamber 11 via the diaphragm 30.

The piezoelectric devices 21*b* provided on both ends of the laminate piezoelectric bodies 21 serve as a non-driving portion to which no voltage is applied, and serve as supporters for supporting the piezoelectric devices 21*a* provided at the intermediate portion.

A driving concentration electrode 24 is formed on the rear end surface of each of the piezoelectric devices 21*a* opposing the pressure chamber 11, and the electrode plates 22*a* exposed from the rear end surface of each of the piezoelectric devices 21*a* is electrically connected to the driving concentration electrode 24. Meanwhile, a common concentration electrode 25 is formed on the front end surface of each of the piezoelectric devices 21*a*, and the electrode plates 22*b* exposed from the front end surface of each of the piezoelectric devices 21*a* are electrically connected to the common concentration electrode 25.

Figure 4:
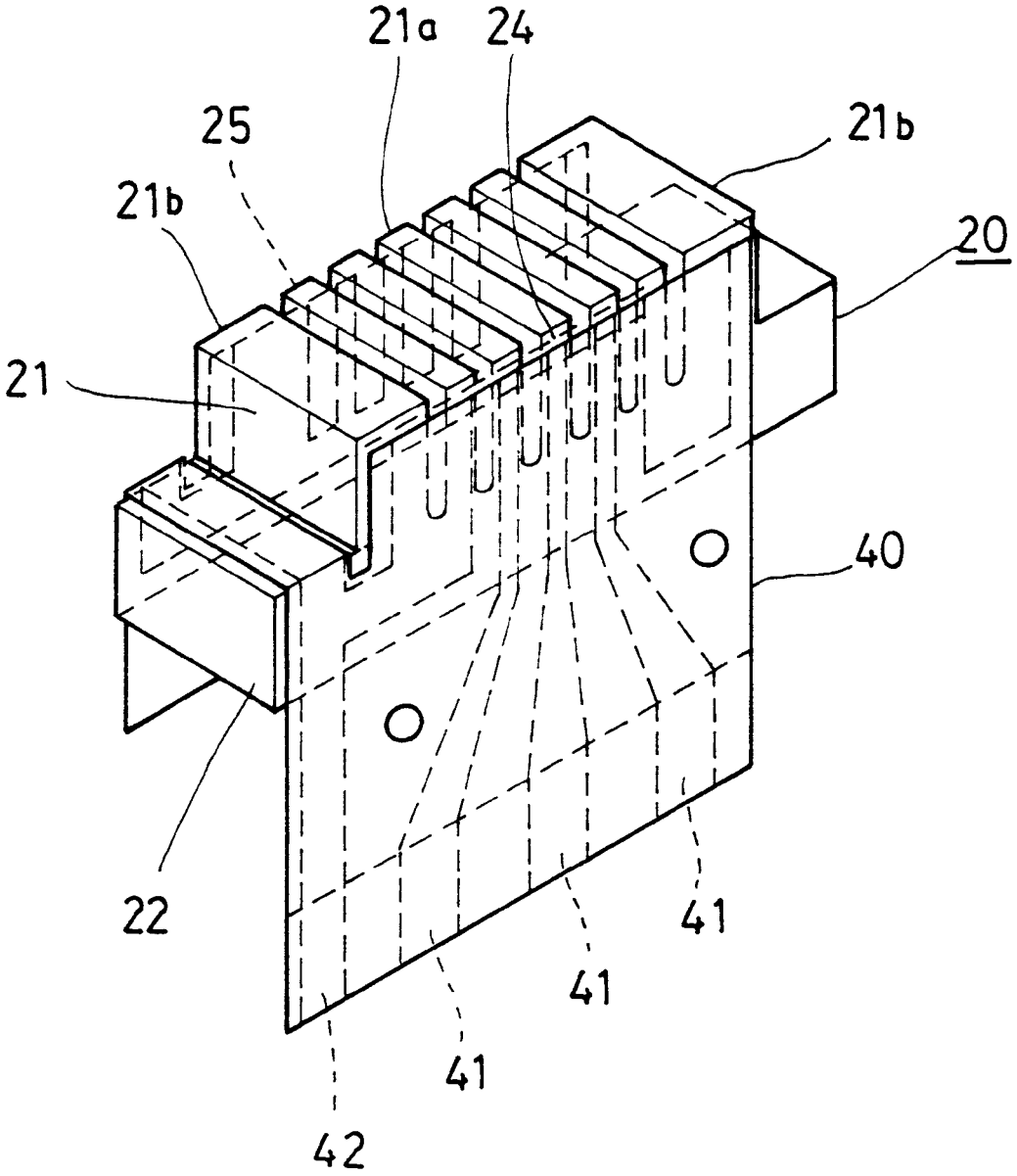
FIG. 4 is a perspective view showing a laminate piezoelectric device unit and a flexible printed-circuit board in the ink jet head shown in FIG. 1.

A voltage is applied to the driving concentration electrode 24 and the common concentration electrode 25 via the flexible printed-circuit board 40 as shown in FIG. 4. A plurality of driving conductive patterns 41 and a common conductive pattern 42 are formed on the flexible printed-circuit board 40, and each of the driving conductive patterns 41 is connected to the driving concentration electrode 24 individually. Further, the common conductive pattern 42 extends to the front end surface side of the laminate piezoelectric bodies 21 through one edge of the base 22 on the upper surface thereof, and is connected to the common concentration electrode 25.

When the voltage is applied between the driving concentration electrode 24 and common concentration electrode 25 via the flexible printed-circuit board 40, each of the piezoelectric devices 21*a* opposing the pressure chamber 11 is deformed in the direction of the thickness thereof. This deformation is transmitted to the diaphragm 30 to change the volume in the pressure chamber 11. As a result, ink filled in the pressure chamber 11 is discharged from front openings 11*a* through the nozzle holes 2*a*.

A frame 50 is provided on the bottom surface of the flow path forming member 10 to cover the periphery of the laminate piezoelectric device unit 20, and the flow path forming member 10 and the laminate piezoelectric device unit 20 are supported by the frame 50.

A front end surface 1*a* of the main body 1 is formed on the front end surface of the flow path forming member 10, the front end of the diaphragm 30 and the front end surface of the frame 50 according to the mode for carrying out the invention as shown in FIG. 2. The nozzle plate 2 is joined onto the front end surface 1*a* of the main body 1. The front openings 11*a* of the pressure chamber 11 are bored in the front end surface 1*a* of the main body 1.

Figure 5:
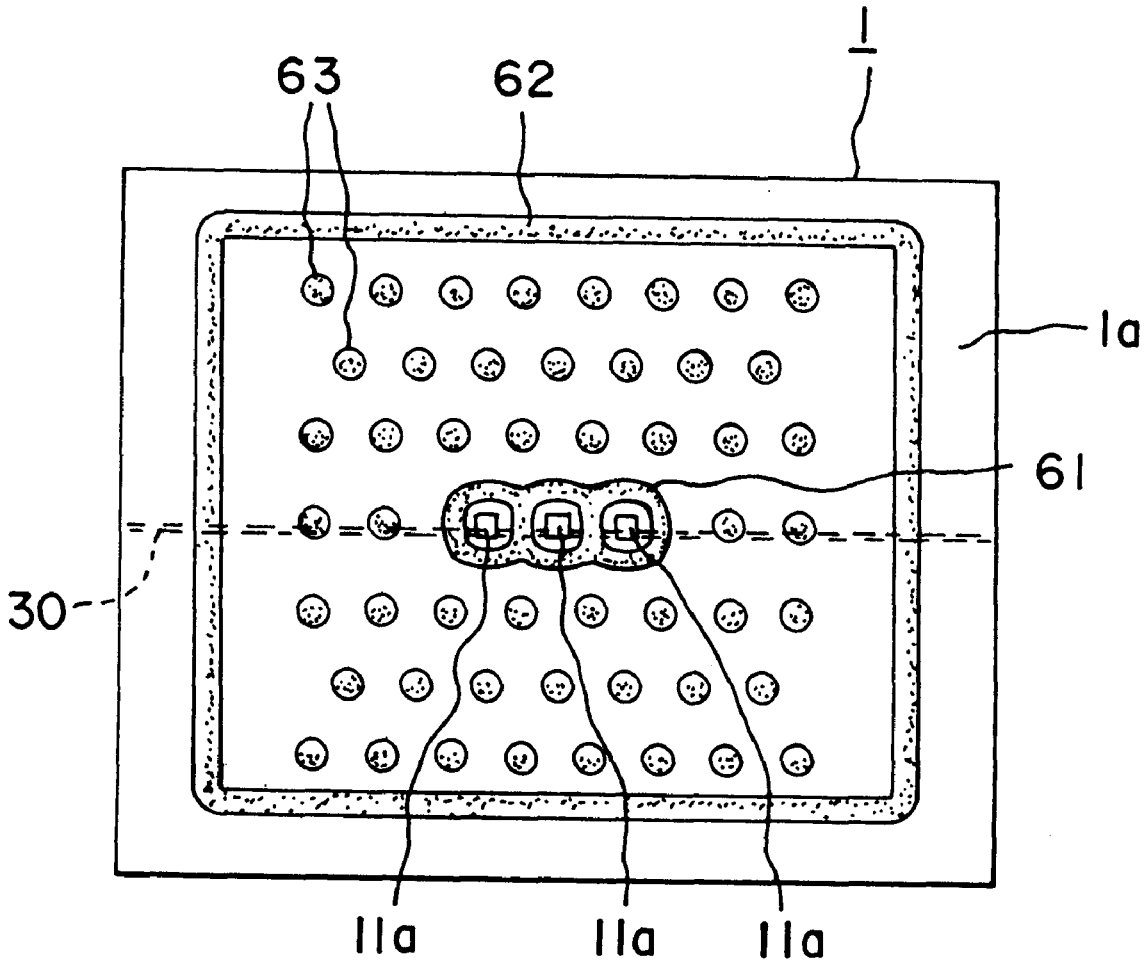
FIG. 5 is a front view showing a state where an adhesive is coated onto the front end surface of the main body of the ink jet head shown in FIG. 1.

The construction of bonding between the front end surface 1*a* of the main body 1 and the nozzle plate 2 will be now described together with the method of manufacturing the ink jet head (see FIG. 1, FIG. 2 and FIG. 5).

The front end surface 1*a* of the main body 1 and the back surface of the nozzle plate 2 are finished to become a flat surface having a uniform surface roughness by grinding or lapping.

Further, a surface to be coated by the adhesive (the front end surface 1*a* of the main body 1 in this case) is irradiated with UV rays, and an organic substance on the front surface forms molecules having a simple structure due to the high energy of the UV rays, and having a strong oxidation strength due to ozone generated by the UV rays, and is vaporized to be removed, so that water repellency is reduced and wettability improves remarkably. As a result, the adhesive can be coated in a desired shape with uniform height.

The adhesive to be used is selected arbitrarily considering the material of the main body 1 and nozzle plate 2. Single-liquid type epoxy adhesive having 220±20 poids in viscosity is used herein. The adhesive contains a plurality of hard true spherical bodies each having an extremely small diameter. The diameter of each of the hard spherical bodies can be set arbitrarily. It must be considered, however, that the diameter of each hard spherical body determines the thickness of the bonding layer formed between the front end surface 1*a* of the main body 1 and the nozzle plate 2. In this mode for carrying out the invention, hard spherical bodies each having a diameter of 0.005 mm are contained in the adhesive.

The adhesive containing such hard spherical bodies is printed and coated onto the front end surface 1*a* of the main body 1 utilizing a screen printing method (adhesive coating step).

FIG. 5 shows a printing pattern for the adhesive relative to the front end surface 1*a* of the main body 1. As shown in the same figure, the adhesive is printed and coated onto the front end surface 1*a* of the main body 1 while being divided into a nozzle seal layer 61, an outer periphery hermetic layer 62 and a reinforcing layer 63.

The nozzle seal layer 61 is formed to encompass the periphery of the front openings 1*a* of each pressure chamber 11. The width of the nozzle seal layer 61 can be set arbitrarily. In this mode for carrying out the invention, the adhesive is printed and coated with a width of 0.06 mm and a height of 0.01 mm, thereby forming the nozzle seal layer 61.

The outer periphery hermetic layer 62 is formed annularly with an arbitrary width along the outer peripheral edge of the region where the front end surface 1*a* of the main body 1 and the nozzle plate 2 oppose each other. In the mode for carrying out the invention, the adhesive is printed and coated with a width of 0.2 mm and a height of 0.01 mm, thereby forming the outer periphery hermetic layer 62.

The reinforcing layer 63 is formed in the intermediate portion between the nozzle seal layer 61 and the outer periphery hermetic layer 62 in a distributed manner. In the mode for carrying out the invention, the adhesive is printed and coated in a plurality of circular patterns each having a diameter of 0.2 mm and a height of 0.01 mm, thereby forming the reinforcing layer 63.

The back surface of the nozzle plate 2 is overlaid and bonded onto the front end surface 1*a* of the main body 1 onto which the adhesive is printed and coated while it is divided into each layer (overlaying step). At this time, each of the nozzle holes 2*a* defined in the nozzle plate 2 is permitted to conform to the front openings 11*a* of the pressure chamber 11, thereby positioning the former relative to the latter.

Thereafter the nozzle plate 2 is pressed relatively against the main body 1 so that the adhesive which is printed and coated onto the front end surface 1*a* of the main body 1 is brought into close contact with the nozzle plate 2 (pressing step). In this pressing step, the nozzle plate 2 is pressed elastically, thereby realizing a uniform bonding state.

That is, when any foreign matter is stuck to the front end surface 1*a* of the main body 1 or the back surface of the nozzle plate 2, stress caused by the pressing is concentrated on the portion contacting the foreign matter on the back surface of the nozzle plate 2, whereby there occurs the likelihood of the deformation of the nozzle plate 2.

Particularly in the mode for carrying out the invention employing the adhesive containing the hard spherical bodies, there occurs distortion in each portion of the nozzle plate 2 causing gaps to be defined when the hard spherical bodies are brought into contact with the nozzle plate 2, whereby there occurs the likelihood of deterioration of the sealing property in the bonding portions.

Such drawbacks can be avoided by pressing the nozzle plate 2 elastically as set forth below.

Figure 6:
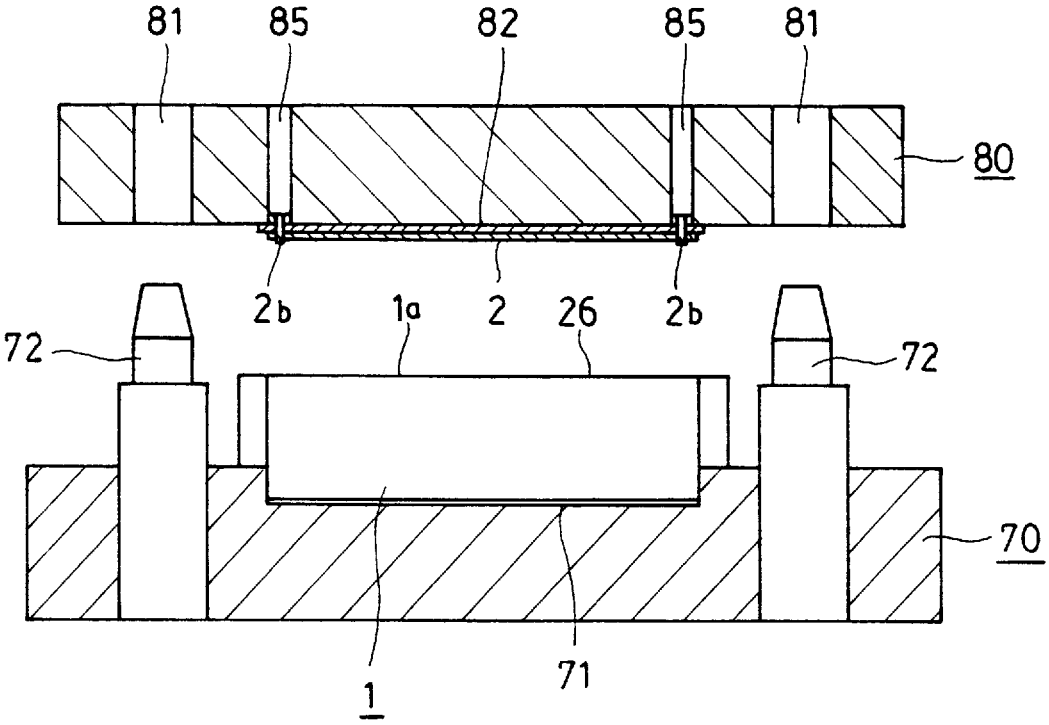
FIG. 6 is a front sectional view showing a jig for manufacturing the ink jet head shown in FIG. 1.
Figure 7:
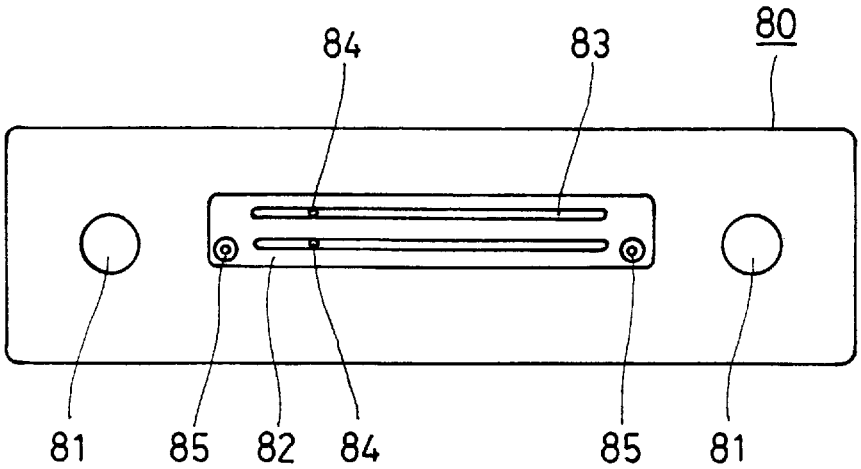
FIG. 7 is a bottom view showing a pressing plate of the jig shown in FIG. 6.
Figure 8:
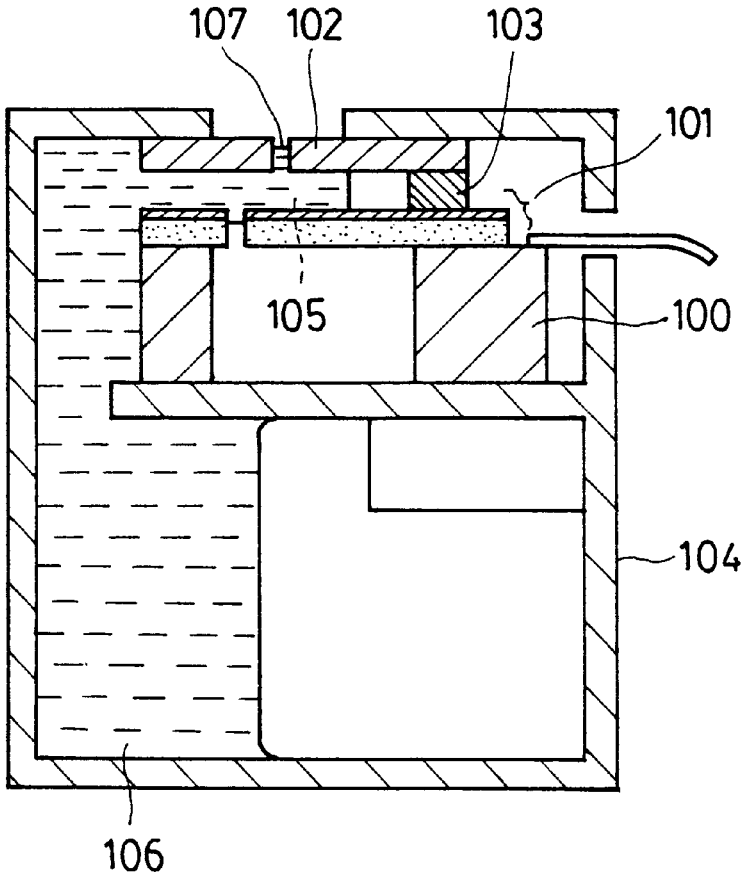
FIG. 8 PRIOR ART
FIG. 8 is a sectional view for explaining the prior art disclosed in the publication of JP-A 3-173651.
Figure 9:
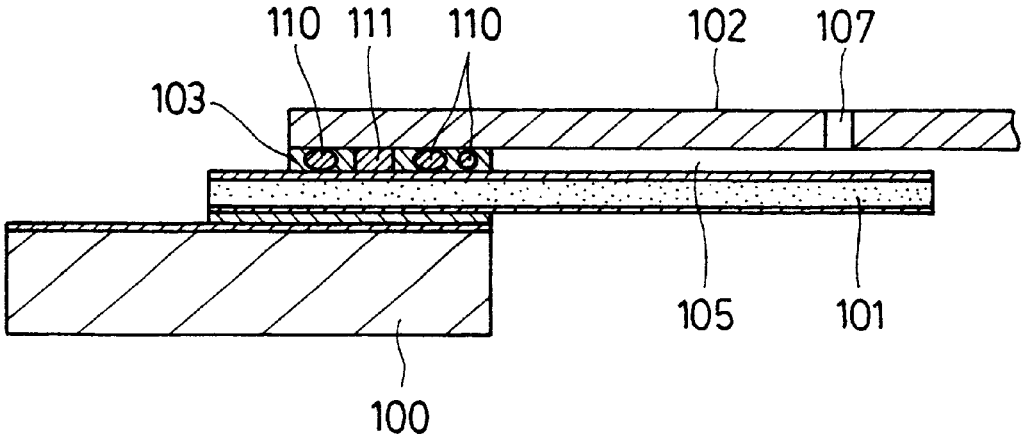
FIG. 9 PRIOR ART
FIG. 9 is an enlarged sectional view for explaining the prior art disclosed in the publication of JP-A 3-173651, like FIG. 8.
Figure 10:
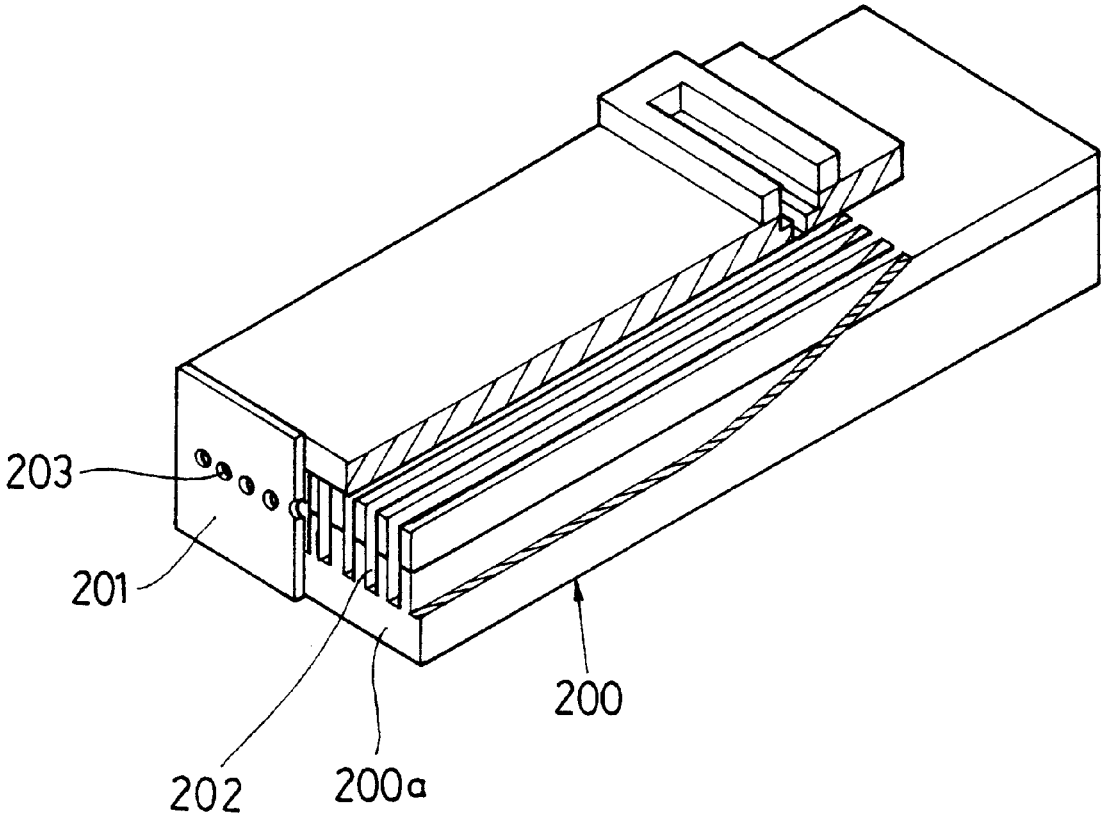
FIG. 10 PRIOR ART
FIG. 10 is a perspective view for explaining another prior art disclosed in the publication of JP-A 5-220966.
Figure 11A:
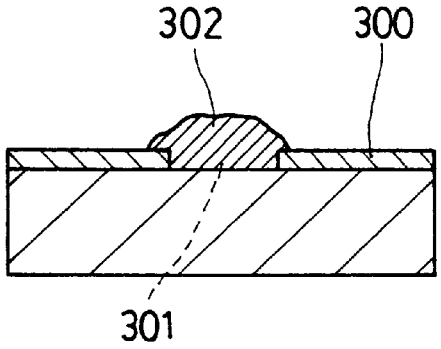
FIG. 11A PRIOR ART
FIG. 11A is a sectional view for explaining the prior art disclosed in the publication of JP-A 5-220966, like FIG. 10.
Figure 11B:
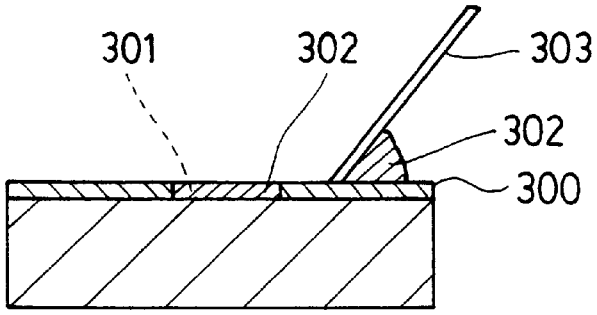
FIG. 11B PRIOR ART
FIG. 11B is a sectional view continued from FIG. 11A.
Figure 11C:
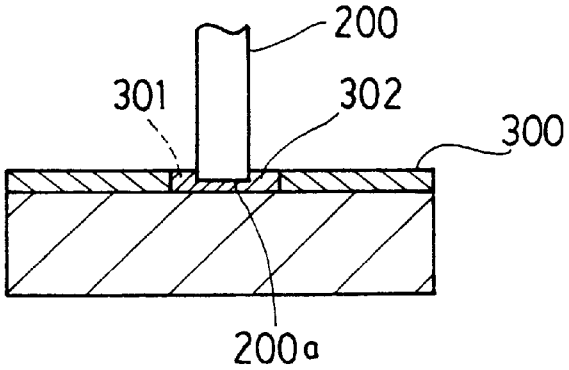
FIG. 11C PRIOR ART
FIG. 11C is a sectional view continued from FIG. 11B.

FIG. 6 is a sectional view showing the jig for manufacturing the ink jet head capable of performing the overlaying step and the pressing step easily and accurately. Further, FIG. 7 is a bottom view of a pressing plate of the jig for manufacturing the ink jet head.

The jig for manufacturing the ink jet head is provided with a main body 70 of the jig for supporting the main body 1 and a pressing plate 80 for supporting the nozzle plate 2.

A positioning fixed portion 71 for positioning the main body 1 is formed in the main body 70 of the jig. In the mode for carrying out the invention, the positioning fixed portion 71 for positioning the main body 1 is formed by a recessed part having a shape conforming to the shape of the rear end portion of the main body 1, wherein the rear end portion of the main body 1 is engaged with the positioning fixed portion 71 while the front end surface 1*a* of the main body 1 is directed upward so that the main body 1 can be automatically positioned and fixed.

Positioning pins 72 protrude from both side edge portions of the main body 70 of the jig and positioning holes 81 in which the positioning pins 72 are engaged are defined in both side edge portions of the pressing plate 80. The pressing plate 80 can be slid along the positioning pins 72 in a state where the positioning holes 81 are engaged with the positioning pins 72 of the main body 70 of the jig.

A plate-shaped elastic member 82 is provided on the bottom surface of the pressing plate 80 opposing the positioning fixed portion 71 for positioning the main body as shown in FIG. 7. The elastic member 82 is formed by printing, for example, a liquid silicon rubber having an adhesive property which is excellent in heat resistance onto the bottom surface of the pressing plate 80 by a screen printing process, and thereafter heating and curing it, whereby an elastic member having a Young's modulus of 5 $kgf/cm^2$ with a height of 0.012 to 0.02 mm is formed.

Small grooves 83 each forming a vacuum chuck are defined in the elastic member 82, and vacuum nozzles 84 are bored in the small grooves 83 to form a suctioning means for suctioning the nozzle plate 2. The vacuum nozzles 84 communicate with a vacuum pump (not shown), and the nozzle plate 2 can be suctioned by and fixed to the elastic member 82 by evacuating the interior of the small grooves 83 by the vacuum pump.

Nozzle positioning pins 85 are provided in the pressing plate 80 to protrude to both side edge portions of the elastic member 82. The positioning holes 2*b* for engaging with the nozzle positioning pins 85 are defined previously in the nozzle plate 2 wherein the nozzle plate 2 can be positioned relative to the pressing plate 80 when the positioning holes 2*b* are engaged with the nozzle positioning pins 85.

The positioning fixed portion 71 for positioning the main body 1, the positioning pins 72 respectively formed on the main body 70 of the jig, the positioning holes 81, the nozzle positioning pins 85 provided on the pressing plate 80 and the positioning holes 2*b* defined in the nozzle plate 2 are respectively adjusted in advance so that the nozzle holes 2*a* of the nozzle plate 2 which is positioned and fixed to the pressing plate 80 oppose the front openings 11*a* of the pressure chamber 11 in the main body 1 which is positioned in the positioning fixed portion 71 of the main body 70 of the jig.

The overlaying step and the pressing step can be easily performed as follows using the jig for manufacturing the ink jet head.

First of all, the main body 1 having the front end surface 1*a* onto which the adhesive is printed and coated is engaged with the positioning fixed portion 71 for positioning the main body 70 of the jig, and the nozzle plate 2 is positioned onto the elastic member 82 of the pressing plate 80 to suction the former to the latter. Thereafter, the pressing plate 80 is engaged with the positioning pins 72 to slide the pressing plate 80 toward the main body 70 of the jig.

After the nozzle plate 2 suctioned by the pressing plate 80 contacts the adhesive which is printed and coated onto the front end surface 1*a* of the main body 1, a given pressing force is applied so that the nozzle plate 2 is bonded to the front end surface 1*a* of the main body 1. At this time, since the elastic member 82 is interposed between the pressing plate 80 and the nozzle plate 2, the nozzle plate 2 is pressed elastically. In this state, a heating process is performed for a given time to cure the adhesive.

The adhesive layer is formed by the adhesive between the front end surface 1*a* of the main body 1 and the nozzle plate 2 which are bonded to each other as set forth above. The adhesive layer comprises the nozzle seal layer 61, the outer periphery hermetic layer 62 and the reinforcing layer 63 as set forth above, and among them, the nozzle seal layer 61 prevents ink discharged from the front openings 11*a* of the pressure chamber 11 from leaking between the bonding surfaces. The outer periphery hermetic layer 62 prevents moisture, dust, etc., from entering between the bonding surfaces from the outside. The reinforcing layer 63 sufficiently secures the bonding strength between the main body 1 and the nozzle plate 2.

As a result of forming the adhesive layer in the required minimum region, the expansion of adhesive can be restrained, thereby preventing the harmful effect that the nozzle holes 2*a* are blocked owing to the expansion of the adhesive.

Further, since the hard spherical bodies are contained in the adhesive in the mode for carrying out the invention, they act as supports when the nozzle plate 2 is pressed and brought into contact with the main body 1, thereby preventing the adhesive layer from being collapsed. As a result, the expansion of the adhesive can be further restrained, thereby forming an adhesive having a uniform thickness, so that the bonding strength is stabilized.

Although the adhesive is coated onto the front end surface 1*a* of the main body 1 in the mode for carrying out the invention set forth above, the adhesive may be coated onto the back surface of the nozzle plate 2 to overlay on the main body 1.

Further, as the feature of the present invention resides in the bonding portion between the main body and the nozzle plate, the other components may be appropriately changed in design.

INDUSTRIAL APPLICABILITY

The present invention has an effect in the improvement of accuracy of the ink jet head employed by an ink jet printer, particularly, in the bonding between the main body and the nozzle plate in appropriate states, thereby lowering the defective fraction of manufactured ink jet heads remarkably.

What is claimed is:

1. An ink jet head comprising a main body for changing the volume in a pressure chamber by deformation of a laminate piezoelectric device, and feeding ink filled in the pressure chamber toward front openings of the pressure chamber, a nozzle plate having nozzle holes communicating with the front openings of the pressure chamber, and an adhesive layer formed between the front end surface of the main body and the nozzle plate by an adhesive, said adhesive layer formed between the main body and the nozzle plate comprises a nozzle seal layer circumscribing the nozzle holes and the periphery of the front openings of the pressure chamber to prevent ink leakage between the nozzle plate and the main body, an outer periphery hermetic layer formed annularly around the outer periphery of a region in which the main body and the nozzle plate oppose each other to prevent moisture entering between the nozzle plate and the main body, and a reinforcing layer being distributed in an intermediate portion between the nozzle seal layer and the outer periphery hermetic layer to secure the bond strength.

2. The ink jet head according to claim 1, wherein the adhesive layer contains a plurality of spherical bodies.

* * * * *